United States Patent [19]

Watanabe et al.

[11] 4,280,962

[45] Jul. 28, 1981

[54] METHODS FOR REFINING OILS AND FATS

[75] Inventors: Haruo Watanabe, Yachiyo; Mutsuhito Watanabe, Narashino; Takao Arima, Funabashi; Kosei Yamada, Ibaraki, all of Japan

[73] Assignee: Showa Sangyo Co., Ltd., Tokyo, Japan

[21] Appl. No.: 98,023

[22] Filed: Nov. 28, 1979

[30] Foreign Application Priority Data

Nov. 30, 1978 [JP] Japan ..... 53-147140

[51] Int. Cl.[3] ..... C11B 3/04; C11B 3/06

[52] U.S. Cl. ..... 260/424; 260/425; 260/426; 260/427

[58] Field of Search ..... 260/424, 425, 426, 427

[56] References Cited

U.S. PATENT DOCUMENTS

| | | | |
|---|---|---|---|
| 2,510,379 | 6/1950 | Christenson | 260/424 |
| 4,089,880 | 5/1978 | Sullivan | 260/424 |

*Primary Examiner*—John F. Niebling

*Attorney, Agent, or Firm*—Oblon, Fisher, Spivak, McClelland & Maier

[57] ABSTRACT

A method of refining animal and vegetable oils and fats comprising mixing said oils and fats with an alkaline solution, admixing the resulting mixture with an acid solution, separating insoluble matter from the admixture, and, if required, treating the admixture with conventional adsorption and steam distillation techniques.

10 Claims, No Drawings

METHODS FOR REFINING OILS AND FATS

BACKGROUND OF THE INVENTION

1. Field of the Invention

This invention relates to methods for refining oils and fats.

2. Description of the Prior Art

Alkali refining methods have been used widely in refining oils and fats. When this method is applied to the refining of oils containing large amounts of gummy substances, the oil is usually subjected to a pretreatment such as degumming. The degumming is usually carried out by adding water, acid or other chemicals to the crude oil and then separating the gummy substance with centrifugation in the hydrated or coagulated form.

However, this degumming process is usually not sufficient to entirely remove the gummy substance from the oil and traces of the gummy substance remain in the oil. Therefore, if required, the partially degummed oil is further treated with acids such as phosphoric acid, and then deacidification is carried out by contacting the oil with an aqueous solution of alkaline compound in order to neutralize free fatty acid and other acids as well as to saponify, hydrate and coagulate the gummy substance left in the oil. The influence of gum on the quality of the oil is eliminated entirely by these treatments as the gummy substances are removed from the oil.

Although the alkali refining method is very advantageous in removing the gummy substance from the oil, this method has the following disadvantage. The free fatty acid in the oil reacts with the alkali to form soap and is separated from the oil phase in the deacidification process of the alkali refining method. The separated soap called "soapstock" is usually decomposed by an acid such as sulfuric acid in order to recover the fatty acid. In the course of this acid treatment, a large amount of waste water called "acid water" is produced which is high in acidity and BOD value. The deacidified oil after separation of soap from the oil is then washed with water. Therefore, a large amount of waste water is produced. As it contains a large amount of oil, it is not allowed to discharge the waste water from the factory without treatment by the pressure floatation method or by the activated sludge process. Therefore, the alkali refining process is not always advantageous, since a large investment is required in the refineries to avoid environmental pollution according to the various regulations which are becoming stricter.

The alkali refining process has further disadvantages which are the loss of neutral oil entrained in the soap and the loss of neutral oil saponified in the course of deacidification accompanied by the neutralization of the free fatty acid.

In the steam refining method, crude or degummed oils and fats are directly decolorized and deodorized (as well as deacidified). Since this method does not have the disadvantages of the alkali refining method such as the loss of neutral oil and the polution by waste water, this process has many advantages over alkali refining process. However, the steam refining method does not include sufficient degumming process as in the alkali refining process, therefore it is necessary to treat the oil with a complete degumming process before steam refining, to remove the gummy substance exhaustively from the oil.

The complete degumming before steam refining is practically difficult and it is not always done sufficiently despite the use of various degumming agents such as acids and salts. Even when the oil seems to be sufficiently degummed, decolored and deodorized judging from the appearance, the oil is often far inferior to the oil refined by the other method in oil flavor, especially when the oil is heated. This shows that the steam refining method still has many problems to be solved.

It is also found that the oil refined by steam refining method is often inferior in flavor and odor when heated as compared to the oil refined by the alkali refining method, even when the oil to be treated does not contain much gummy substance originally, such as, palm oil and lard. From this point of view, it is presumed that the use of an alkaline solution in refining oil plays a part not only in removing the gum from the oil but also in eliminating or inactivating the factors affecting the flavor of the refined oil. Although the steam refining method has many advantages over alkali refining from the economical point of view, the former has still many problems to be solved. Oil refineries are obliged, at present, to utilize the conventional alkali refining method, even though this method has the above-noted disadvantages.

A need therefore, continues to exist for an oil or fat refining process which avoids the production of waste water, lowers environmental pollution, diminishes the loss of neutral oil in the refining process and is economical in operation.

SUMMARY OF THE INVENTION

Accordingly, one object of the invention is to provide an economical method for the refining of oils and fats.

Another object of the invention is to provide a method for the refining of oils and fats which avoids the production of waste water and the concomittant environmental pollution.

A further object of the invention is to provide a method for the refining of oils and fats which diminishes the loss of neutral oil in the refining process.

Briefly, these objects and other objects of the invention, as hereinafter will become more readily apparent, can be attained by providing a method of refining oils and fats wherein the separation of soaps and impurities after alkali treatment is eliminated and the washing with water after acid treatment is eliminated.

DESCRIPTION OF THE PREFERRED EMBODIMENTS

This invention relates to a method of refining animal and vegetable oils and fats, and more particularly to a method of refining crude oils and fats of animal and vegetable origin or oils and fats which have been subjected to a conventional pre-treatment. The invention is characterized by mixing said oils and fats with an aqueous solution of alkaline compounds, admixing the resulting mixture directly with an aqueous solution of acids without separating the formed products after treatment with alkaline solution, separating insoluble matter containing gum as the main component from the mixture without washing the mixture with water after acid treatment, and, if required, treating the resulting mixture with conventional methods such as adsorption and steam distillation; or to a method of refining said oils and fats characterized by contacting said oils and fats with said aqueous solution of alkali compounds then with said aqueous solution of acids without separating the formed products after treatment with alkaline solution, by treating with the conventional adsorption method without washing the mixture with water after acid treatment and, if required, by treating the mixture with the method of steam distillation.

The inventors have studied oil refining methods having advantageous characteristics of both alkali and steam refining methods and accomplished the present invention. Namely, this invention relates to a method of refining animal and vegetable oils and fats comprising the following steps:

(1) pre-treatment of crude oils and fats (optional), (2) treatment of oils and fats with alkaline solution, (3) hydrolysis of soap with an aqueous solution of acids, (4) separation of insoluble matter, (5) treatment of oils and fats with adsorbant (optional)

(6) treatment of oils and fats with steam distillation (optional).

The particulars of these steps are described as below.

(1) The pre-treatment of crude oils and fats

The oils and fats to be treated by the method of the invention are crude oils and fats of animal and vegetable origin or the oils and fats subjected to a conventional pre-treatment before the main refining process. Depending on the kind of the oily material or the method of extraction of the oil, these oils and fats can be refined without pre-treatment, namely directly treated with steps 2 to 6. However, most of the extracted crude oils and fats are subjected to a pre-treatment such as physical removal of impurities from the oil by filtration or sedimentation, degumming by acids or alkali substances, insolubilization of gummy substance by an aqueous solution of acids and dehydration of the oil. This step is an optional one and indicates a pre-treatment before the main refining step for the elevation of efficiency of the main refining steps of the invention. The pre-treatment consists mainly of:

(a) The degumming of crude oil

This is a conventional degumming step. The method and condition are the same as those of usual degumming steps. Water, including the live steam; organic or inorganic acids; alkali compounds; and the like known as the degumming agent can be used. The amount of these agents varies usually from 0.01 to 5% by weight of the oil and fats according to the origin or nature of the crude oils and fats. The gummy substance hydrated and coagulated by these degumming agents is separated from the oils and fats by means of centrifugation. It is desirable that the gummy substance is removed to as great an extent as possible in this step. Depending on the amount or the nature of the gummy substance contained in the crude oils and fats, this degumming can be omitted and the crude oil is subjected directly to the following step (b) or 2.

(b) The treatment of crude or degummed oils and fats with an aqueous solution of acids This step is for insolubilization of the gummy substance in the crude oil or that which remains in the degummed oil after treatment with step (a).

Acids used in this step are organic and inorganic acids such as hydrochloric acid, sulphuric acid, phosphoric acid, acetic acid, acetic anhydride, and citric acid. It is possible to use mixtures of more than two kinds of these acids. These acids are added to the oils and fats as an aqueous solution of suitable concentration. The resulting mixture is agitated by suitable means for the interval of from a few seconds to a few hours at a temperature of from room temperature to 100° C. The amount of acids to be added is usually 0.01–1% by weight of the oils and fats. The gum conditioning of this step is helpful to the saponification and coagulation of the gummy substance in the following step (2). As this step is not essential to the process it can be omitted and the crude oil subjected directly to step (2).

(2) The alkali treatment

This step is, as in the conventional deacidification method, for neutralization of free fatty acid, saponification, hydration and coagulation of gummy substance, and decolorization of coloring matter in the oils and fats. Alkali compounds such as caustic soda and soda ash are added to the oil. Other alkali compounds can, of course, be used as in the usual alkali treatment.

The object of this step is not only as described above, but also insolubilization or inactivation of the substances which affect the flavor of the refined oils and fats. Therefore, the amount of alkali to be used is not always necessary to be equivalent to the amount of alkali needed to neutralize free fatty acid in the oil. The alkali compounds can be used for partial neutralization of free fatty acids. However, it is often more convenient in practice to establish the amount of alkali compounds based on the amount of free fatty acids contained in the oil. When the pre-treatment is done by an aqueous solution of acid, the amount of alkali should take into consideration the amount of alkali necessary for the neutralization of said acid.

The condition of the treatment depends on the facilities and the equipment in which the oil is treated. The contact of an aqueous solution of alkali and the oil is carried out at a temperature of from room temperature to 100° C. for the interval of from several seconds to several hours. The facilities and the equipment used for the conventional refining method can be used for the method of the invention.

It is one of the characteristics of the present invention that the following step (3) is carried out directly without separating the soap and gummy substance produced and coagulated in the step of alkali treatment.

(3) Hydrolysis of soap with aqueous solution of acids

The oil treated with the aforementioned alkali in which soaps and coagulated gummy substance are suspended is contacted with an aqueous solution of acids at a temperature of room temperature −100° C. for several seconds—several hours.

The object of this step is to hydrolyze the soap generated in the oil to form free fatty acid which dissolves in the oil. As a result of this treatment, the coagulated gummy substance, added chemical agents and the neutralized products of these agents remain in the oil as insoluble matter. Thus, the impurities which affect the quality of the refined oils and fats are readily separated and removed from the oil by means of centrifugation, filtration, adsorption and other suitable methods.

The acids used in this step are mentioned in the above step (b), i.e., organic or inorganic acids such as hydrochloric acid, sulfuric acid, phosphoric acid, oxalic acid, acetic acid, acetic anhydride and citric acid. The amount of acid to be added is not always required to be enough to decompose all of the soap, but to decompose only a part of the soap. The equipment or apparatus used in alkali treatment can also be used in this step. The contact between acids and soaps can be accelerated by use of an homogenizer. It is also one of the characteristics of the present invention that the washing with water is not necessary after this step.

(4) Separation of insoluble matter

The impurities remaining in the oil as insoluble matter after the treatment (3) are removed from the oil as oil foots by means of centrifugation, filtration and other suitable methods. As the oil foots consist mainly of gummy substance, the amount of the separated oil foots is far smaller than that of foots produced by the conventional alkali refining method. Therefore, the entrained loss of neutral oil is diminished greatly compared with that of the conventional method.

After the treatment 1-4, the oil can be used as the refined oil, or after addition of a small amount of water to the oil and further separation of impurities the oil can be used as the refined oil.

This step of separating the insoluble matter can be omitted depending on the amount or the nature of said insoluble matter, and the mixture can be subjected directly to the following adsorption (decolorization) process. In this case, washing with water is also not necessary.

(5) The treatment with adsorbent (decolorization)

The oil from which impurities are separated or not separated in the step (3) is treated directly with an adsorbent such as activated clay or active carbon. Washing with water is not carried out by conventional methods and apparatus under conventional conditions. The coloring matter, gummy substance and other impurities in the oil are substantially entirely adsorbed on the adsorbent and removed from the oil.

(6) Steam distillation step (deacidification and deodorization)

This step is a conventional deodorization process. The fatty acid which was made free by hydrolysis of soap in the step (3) is distilled entirely away from the oil with odorous matter. Thus, the deacidification and deodorization which are the characteristics of the steam refining are carried out simultaneously. The coloring matter in the oil is decomposed due to the heat and the oil is changed to light colored. Since the gummy substance has already been removed entirely from the oil, the oil does not color due to the presence of gummy substance. The conventional steam distillation method apparatus and the conventional condition can be applied to this step.

The above mentioned is the embodiment of the invention. The characteristic of the present invention resides in the finding that the oil is directly treated with acids without separating the products after alkali treatment. Among said products, the soap is hydrolyzed with acids to form free fatty acid which dissolves in the oil, and the gummy substance only remains in the oil as the insoluble matter.

According to this procedure, the gummy substance can be removed to the extent as in the usual alkali refining process but not in the entrained form in the soap. Moreover, the free fatty acids can be distilled efficiently away from the oil by the steam refining method. This means that the method of the present invention is the novel combined method of alkali refining and steam refining processes having the advantages of both refining methods without production of waste water.

The effects and advantages of the present invention are as follows:

(1) The oil is substantially free from gummy substance which affects the quality of the deodorized oil. The flavor of the refined oil is excellent especially when the oil is heated.

(2) As the soap stock produced in the present alkali treatment is not separated from the oil, acid water generated in the usual recovery process of free fatty acid from the soap stock is not produced in the present refining process. Furthermore, washing with water after separating the soap stock in the usual alkali refining process is not necessary in the present process. Therefore, the method of the present invention is not accompanied by the generation of waste water and is a clean method which is effective in protecting the environment from pollution.

(3) As only small amounts of oil foots consisting mainly of gummy substance are produced in the present method, the entrained loss of neutral oil is decreased remarkably.

(4) The fatty acids in the oil can be recovered not in the form of soap stock but in the form of fatty acids directly in the steam distillation (deodorization) step of the invention. Therefore, decomposition and distillation of soap stock and the facilities for such treatment are not required. As the quality of the refined oils and fats produced by the method of the invention is excellent, this method is very economical.

The method of the present invention can be applied favorably to the refining of all kinds of vegetable and animal oils and fats such as soybean oil, rape seed oil, rice oil, corn oil, cotton seed oil, sunflower oil, safflower oil, sesame oil, peanut oil, linseed oil, lard, beef tallow, mutton tallow, fish oil and the oils and the fats of marine animals.

Having generally described this invention, a further understanding can be obtained by reference to certain specific examples which are provided herein for purposes of illustration only and are not intended to be limiting unless otherwise specified.

EXAMPLE 1

0.025% by weight of 85% orthophosphoric acid was added with stirring at 250 r.p.m. at a temperature of 35° C. to 1000 g of crude safflower oil having acid value of 1.08 and phospholipid content of 10500 ppm. Thorough agitation was continued for 2 hours under the above conditions. An aqueous solution of sodium hydroxide of 16° Be was added to the resulting mixture in an amount 10% more than the amount required to neutralize said orthophosphoric acid and the free fatty acid in the oil and the reaction was continued for 2 hours. Then 85% orthophosphoric acid was added to the mixture in an amount sufficient to hydrolyze the formed soaps and the reaction was continued for 2 hours. The mixture was heated to 70° C., the insoluble matter was centrifuged away from the mixture, and the pure oil was dehydrated conventionally to obtain 995 g of non-break safflower oil with the yield of 99.5%. The acid value of the oil was 1.12 and the content of phospholipid was 110 ppm.

EXAMPLE 2

0.75 g of 80% orthophosphoric acid was added with stirring at 250 r.p.m. at a temperature of 35° C. to 1500 g of degummed soybean oil in 2L beaker having acid value of 1.72 and phospholipid content of 3160 ppm.

The amount of phosphoric acid was 0.05% against the oil. After thorough mixing for 1 hour, 23.97 g (in an amount 30% more than the amount required to neutralize the orthophosphoric acid and free fatty acid) of sodium hydroxide of 18° Be was added to the mixture and the reaction was continued for 1 hour. Then 8.57 g of 80% orthophosphoric acid was added to the resultant mixture in an amount sufficient to hydrolyze the formed soaps and the mixture was agitated for 2 hours. The temperature was raised to 70° C. and the insoluble matter was removed by centrifugation producing 1494 g of treated oil (yield 99.6%) and 39.1 g of oil foots mainly containing chemical agent and gummy substance. The treated oil has acid value of 1.81 and phospholipid content of 60 ppm.

2% by weight of activated clay was added to 1200 g of the treated oil, and the oil was decolorized by contacting said oil with clay under reduced pressure of 30 mmHg at 105° C. for 15 minutes. The adsorbents were filtered off and 1188 g of decolorized oil (yield 99.0%) was obtained. 1000 g of the decolorized oil thus obtained was subjected to steam distillation under reduced pressure of 2 mmHg at 260° C. for 60 minutes to obtain 986 g of deodorized oil (yield 98.6%) and 13.0 g of distillate having neutralization value of 152.

The following comparison test 1 was carried out by the conventional alkali refining method.

Comparison Test 1

1500 g of degummed soybean oil was treated with orthophosphoric acid and alkali under the condition described in Example 2 and was heated to 70° C. Soap stock was separated by centrifugation and 1467 g (yield 97.8%) of deacidified oil and 60.5 g of soap stock were obtained. The deacidified oil was washed twice with hot water in an amount of 30% against the oil by the conventional manner and was dehydrated. About 880 g of the washing waste water had pH value of 10.3, entrained oil of 1250 ppm and COD of 570 ppm. Then 1200 g of the dehydrated oil was decolorized with 1% of activated clay under the aforementioned condition to obtain 1194 g of decolorized oil. Thereafter, 1000 g of decolorized oil was deodorized under the aforementioned conditions to obtain 995 g (yield 99.5%) of deodorized oil and 4.8 g of distillate having neutralization value of 67.

Apparently, from the above description, the useful fatty acid can be recovered without producing soap stock or waste washing water in the method of the present invention. In addition to the above advantage, the yield of the refined oil in the conventional alkali refining method is 96.8% and that of the method of the invention is 97.2% which is far superior to the former. The nature of deodorized oil was shown in Table 1.

TABLE 1

| | Example 2 | Comparison Test 1 |
|---|---|---|
| Color (Lovibond 133.4 mm cell) | $2^Y \times 0.2^R$ | $3^Y \times 0.3^R$ |
| Acid value | 0.02 | 0.02 |
| Phospholipid | 5 ppm | 8 ppm |

As shown in Table 1, no difference could be seen between the samples in the quality of the oil and the flavor was excellent.

EXAMPLE 3

The refining process was carried out as in Example 2 except the amount of orthophosphoric acid added after treatment of sodium hydroxide was changed to one half of the amount used in Example 2.

EXAMPLE 4

0.1% by weight of 85% orthophosphoric acid was added with stirring at 300 r.p.m. at 50° C. to 2000 g of crude soybean oil having acid value of 1.52 and phospholipid content 12500 ppm, and after agitation for 30 minutes, aqueous solution of sodium hydroxide of 22° Be was added to the mixture in an amount 50% more than the amount sufficient to neutralize the orthophosphoric acid and free fatty acid in the oil and agitated the mixture for 30 minutes. Then 50% sulfuric acid was added to the resultant mixture in an amount sufficient to hydrolyze the soap and agitated the mixture under stirring for 1 hour. After acid treatment, the mixture was treated as in Example 2 to obtain the treated oil having acid value of 1.70 and phospholipid content of 210 ppm. The treated oil was decolorized with 2% of activated clay and 0.2% of active carbon under reduced pressure at 100° C. for 30 minutes and then deodorized by the conventional method.

EXAMPLE 5

Degummed rape seed oil having acid value of 1.20 and phospholipid content of 6600 ppm was heated to 40° C. by plate heater. 0.1% by weight of 75% orthophosphoric acid was added to the oil and mixed in a mixer. Sodium hydroxide of 20° Be was added to the mixture in an amount 25% more than the amount sufficient to neutralize orthophosphoric acid and free fatty acid. The resultant mixture was transferred to Dispermill (made by Hosokawa ironworks) where 85% orthophosphoric acid was added to the resultant mixture in an amount sufficient to hydrolyze the soap. The mixture was stirred at high speed and was heated to 75° C. by plate heater. The oil foots were separated by DeLaval centrifuge. The treated oil thus obtained was decolorized with 1.5% of activated clay at 110° C. for 10 minutes and then deodorized by the conventional method.

EXAMPLE 6

Sodium hydroxide of 14° Be was added with stirring in Homo-mixer (made by Tokushukika-kogyo) at 5000 r.p.m. to 2000 g of crude corn oil having acid value of 4.63 and phospholipid content of 18300 ppm at a temperature of 30° C. The amount of sodium hydroxide was sufficient to neutralize the fatty acid. After agitation for 10 minutes, 50% citric acid solution was added to the resultant mixture in an amount sufficient to hydrolyze the soap and the reaction continued for 15 minutes. After heating to 70° C., said mixture was centrifuged to obtain the treated oil having acid value of 4.11 and phospholipid content of 35 ppm. The treated oil was decolorized with 2% by weight of activated clay and deodorized by the conventional method.

EXAMPLE 7

20% sodium carbonate solution was added with stirring at 250 r.p.m. to 1000 g of crude palm oil produced in Sumatra having acid value of 8.39 and phospholipid content of 1300 ppm at a temperature of 50° C. The amount of the added sodium carbonate was one-fifth of the amount required to neutralize the fatty acid. After agitation for 2 hours, 20% hydrochloric acid was added to the resultant mixture to an amount sufficient to hydrolyze the soap. After agitation for 1 hour, the mixture was heated to 70° C. and centrifuged. Then the treated oil was decolorized with 2% of clay and 0.5% of active carbon and deodorized by the conventional method. The characteristics of the deodorized oil in Examples 3–7 are shown in Table 2. As shown in Table 2, all products produced according to the method of the invention are good in quality and the flavor of the products are excellent in heated condition.

TABLE 2

| | Yield (%) | Color (Lovibond 133.4 mm cell) | Acid Value | Phospholipid (ppm) | Flavor |
|---|---|---|---|---|---|
| Example 3 | 96.9 | $3^Y \times 0.2^R$ | 0.02 | 3 | good |
| Example 4 | 96.1 | $3^Y \times 0.3^R$ | 0.02 | 11 | good |
| Example 5 | 97.4 | $5^Y \times 0.5^R$ | 0.03 | 5 | good |
| Example 6 | 95.8 | $7^Y \times 0.7^R$ | 0.06 | 2 | good |
| Example 7 | 92.8 | $12^Y \times 1.0^R$ | 0.05 | 6 | good |

The advantages of the method of the invention illustrated in Examples 3–7 are the same as stated in Example 2.

EXAMPLE 8

Sodium hydroxide solution of 12° Be was added to 1000 g of crude edible beef tallow obtained by melting method having acid value of 1.86 and phospholipid content of 240 ppm. The amount of the added sodium hydroxide was one-tenth of the amount required to neutralize the fatty acid. The mixture was agitated for 90 minutes at 60° C. 80% orthophosphoric acid was added to the resultant mixture in an amount necessary to hydrolyze the soap. After agitation for 90 minutes, 2% by weight of activated clay was added and contacted with said mixture under reduced pressure for 30 minutes at 100° C. Upon filtration of the adsorbent, the oil was subjected to steam distillation under reduced pressure of 3 mm Hg at 250° C. for 90 minutes. Thus 974 g of deodorized oil was obtained.

The following comparison test 2 was carried out according to the conventional alkali refining method.

Comparison Test 2

Sodium hydroxide solution of 12° Be was added to 1000 g of aforementioned crude tallow. The amount of sodium hydroxide added to the tallow was 30% more than the amount required to neutralize the free fatty acid. The mixture was deacidified at 60° C. by the conventional method and was washed twice with hot water in an amount of 20% by weight to the oil and then dehydrated. The oil was decolorized with 1% by weight of activated clay under reduced pressure at 100° C. for 15 minutes. Thus, 966 g of deodorized oil was obtained.

Comparison Test 3

This comparison test was carried out according to the conventional steam refining method. 1000 g of aforementioned crude tallow was decolorized with 4% by weight of activated clay under reduced pressure at 100° C. for 30 minutes and was deodorized under the aforementioned conditions. Thus 966 g of deodorized oil was obtained. The characteristics of the deodorized oils are shown in Table 3.

TABLE 3

| | Yield (%) | Color (Lovibond 133.4 mm cell | Acid Value | Phospholipid (ppm) | Flavor |
|---|---|---|---|---|---|
| Example 3 (present invention) | 97.4 | $3^Y \times 0.3^R$ | 0.03 | 2 | good |
| Comparison Test 2 (conventional alkali refining method) | 96.6 | $3^Y \times 0.3^R$ | 0.03 | 2 | good |
| Comparison Test 3 (conventional steam refining method) | 96.6 | $5^Y \times 0.6^R$ | 0.03 | 3 | odor of animal oil |

As shown in Table 3, the refining method of the present invention is superior to the conventional alkali or steam refining methods in the yield of the refined oil, and can eliminate the defects in the flavor of the products refined by the conventional steam distillation method.

It is concluded that the refining method of the present invention is a novel method based on the skillful combination of the advantages of alkali and steam refining methods.

Having now fully described this invention, it will be apparent to one of ordinary skill in the art that many changes and modifications can be made thereto without departing from the spirit or scope of the invention as set forth herein.

What is claimed as new and intended to be covered by Letters Patent is:

1. A method of refining an animal or vegetable oil or fat which comprises:

(a) mixing said oil or fat with an aqueous solution of an alkaline substance;

(b) directly admixing the resulting mixture from step (a) with an aqueous solution of an acid;

(c) separating the insoluble matter in the oil or fat from the resulting admixture; and (d) steam distilling the oil or fat.

2. The method according to claim 1, wherein said oil or fat is a crude oil or fat.

3. The method according to claim 2, wherein prior to step (a), said oil or fat is subjected to a degumming step comprising:

(i) contacting said crude oil or fat with a degumming agent which will cause hydration and coagulation of gum-forming substances in said crude oil or fat;

(ii) separating the gummy substance, hydrated and coagulated by said degumming agent, from said oil or fat.

4. The method according to claim 2, wherein prior to step (a), said oil or fat is subjected to an acid treatment step comprising:

(iii) contacting said oil or fat with an aqueous solution of acid.

5. The method according to claim 2, wherein prior to step (a), said oil or fat is subjected to the following sequence of steps:

(i) contacting said crude oil or fat with a degumming agent which will cause hydration and coagulation of gum-forming substances in said crude oil or fat;

(ii) separating the gummy substance, hydrated and coagulated by said degumming agent, from said oil or fat; and (iii) contacting said degummed oil or fat with an aqueous solution of acid.

6. The method according to claim 1, wherein subsequent to step (c) said oil or fat is subjected to a decolorization step comprising:

(iv) contacting said oil or fat with an adsorbent for coloring matter; and (v) separating said adsorbent from said oil or fat.

7. The method according to claim 1, wherein subsequent to step (c), said oil or fat is subjected to the following sequence of steps:

(iv) contacting said oil or fat with an adsorbent for coloring matter;

(v) separating said adsorbent from said oil or fat; and (vi) steam distilling off the free fatty acid formed, during step (b), by the hydrolysis of soaps, which were formed in step (a).

8. A method of refining an animal or vegetable oil or fat which comprises:

(1) mixing said oil or fat with an aqueous solution of acid;

(2) mixing the mixture formed in step (1) with an aqueous solution of an alkaline substance;

(3) directly mixing the mixture formed in step (2) with an aqueous solution of an acid;

(4) separating the insoluble matter from the oil or fat in the mixture formed in step (3);

(5) contacting said oil or fat with an adsorbent for coloring matter;

(6) separating said adsorbent from said oil or fat; and (7) steam distilling off the free fatty acid formed, during step (3), by the hydrolysis of soaps, which were formed in step (2).

9. A method of refining an animal or vegetable oil or fat which comprises:

(A) mixing said oil or fat with an aqueous solution of alkaline compounds;

(B) directly mixing the mixture formed in step (A) with an aqueous solution of an acid;

(C) contacting said oil or fat with an adsorbent for coloring matter, gums and impurities; and (D) separating said adsorbent from said oil or fat.

10. The method according to claim 9, wherein subsequent to step (D) said oil or fat is steam distilled to remove the free fatty acid formed during step (B), by the hydrolysis of soaps, which were formed in step (A).

* * * * *